US005852757A

United States Patent [19]

Tooda et al.

[11] Patent Number: 5,852,757

[45] Date of Patent: Dec. 22, 1998

[54] ELECTROPHOTOGRAPHIC IMAGE FORMING APPARATUS HAVING A DEVICE FOR RECOVERING RESIDUAL TONER

[75] Inventors: Toshio Tooda; Yoshio Yamaguchi; Nobuo Kuwabara; Mituru Sato; Haruyasu Watanabe; Akira Nagahara; Sachio Sasaki; Yoshiya Ishiyama, all of Kawasaki; Hiroshi Kera, Inagi; Masanori Nishido, Inagi; Hisashi Hanzawa, Inagi, all of Japan

[73] Assignee: Fujitsu Limited, Kawasaki, Japan

[21] Appl. No.: 680,959

[22] Filed: Jul. 16, 1996

[30] Foreign Application Priority Data

Aug. 23, 1995 [JP] Japan ..... 7-215066

[51] Int. Cl.[6] ..... G03G 15/00; G03G 21/00

[52] U.S. Cl. ..... 399/119; 399/359

[58] Field of Search ..... 399/111, 113, 399/119, 120, 359, 171, 281, 284

[56] References Cited

U.S. PATENT DOCUMENTS

| | | | |
|---|---|---|---|
| 4,054,381 | 10/1977 | Bernhard | 399/359 |
| 4,376,578 | 3/1983 | Tanaka et al. | 399/359 X |
| 4,563,076 | 1/1986 | Takahashi et al. | 399/171 X |
| 4,616,918 | 10/1986 | Kohyama et al. | 399/284 |
| 4,894,688 | 1/1990 | Taniguchi et al. | 399/359 |
| 5,075,728 | 12/1991 | Kobayashi et al. | 399/281 |
| 5,121,165 | 6/1992 | Yoshida et al. | 399/119 |
| 5,166,472 | 11/1992 | Maeda et al. | 399/281 |
| 5,289,237 | 2/1994 | Hashizume et al. | 399/284 |
| 5,414,500 | 5/1995 | Furukawa | 399/285 |
| 5,552,867 | 9/1996 | Sekino et al. | 399/284 |
| 5,592,267 | 1/1997 | Misago et al. | 399/359 |
| 5,602,631 | 2/1997 | Sakaguchi | 399/284 |

*Primary Examiner*—Fred L. Braun
*Attorney, Agent, or Firm*—Nikaido, Marmelstein, Murray & Oram LLP

[57] ABSTRACT

An electrophotographic image forming apparatus including a toner circulating mechanism for recovering a residual toner scraped from a photosensitive drum to a developing device. The developing device includes a housing for defining a toner chamber, a developing roller rotatably mounted in the housing, an agitator rotatably mounted in the housing and provided in the toner chamber, and a partition member mounted to the housing to define a carrier chamber between the partition member and the developing roller. The toner circulating mechanism directly returns the residual toner scraped from the photosensitive drum to the toner chamber in the developing device. The toner chamber may contain a foreign matter removing device. The partition member may have various shapes.

18 Claims, 20 Drawing Sheets

ELECTROPHOTOGRAPHIC IMAGE FORMING APPARATUS HAVING A DEVICE FOR RECOVERING RESIDUAL TONER

BACKGROUND OF THE INVENTION

1. Field of the Invention

The present invention relates to an electrophotographic image forming apparatus such as a laser beam printer and an LED printer.

2. Description of the Related Art

Recent development of office automation has brought about a wide use of an electrophotographic image forming apparatus such as a laser beam printer in computer output terminal equipment, facsimile equipment, copiers, etc. In such an image forming apparatus, a photosensitive drum is charged to a given potential by a charger, and is next exposed to light according to image information to form an electrostatic latent image on the photosensitive drum. Thereafter, the electrostatic latent image on the photosensitive drum is developed with a toner to form a toner image, which is in turn transferred to a sheet of recording paper. The toner image transferred to the recording paper is next fixed to obtain a hard copy. After the transfer step, the photosensitive drum is de-electrified by an eraser, and the residual toner left on the surface of the photosensitive drum is scraped from the surface of the photosensitive drum by a cleaner, thus completing one cycle of print operation on the photosensitive drum.

As a method of developing the electrostatic latent image on the photosensitive drum, a so-called 1.5-component developing method is known, in which a magnetic carrier is stored in a carrier chamber or a development chamber, and a toner is supplied into the carrier chamber. This developing method does not require control of a toner density, so that a developing device having a simple structure can be provided. However, it is necessary to provide a device for maintaining the toner density at a constant value to maintain a good image quality.

Further, known is a structure that a residual toner scraped from the surface of the photosensitive drum by the cleaner is returned to a toner box of the developing device by a toner circulating mechanism for the purpose of reuse of the toner. The developing device having such a circulating mechanism has a merit that the need for wasting the residual toner is eliminated to improve the efficiency of reuse of the toner.

In a conventional toner circulating mechanism, however, the residual toner is returned to the toner box mounted at an upper portion of the developing device. Accordingly, the residual toner must be fed in an upward steeply inclined path. As a result, the residual toner tends to stay at the bottom of a cleaner housing, causing a reduction in the efficiency of reuse of the toner. Further, if the residual toner returned to the toner box contains foreign matter such as paper pieces and dust, the foreign matter is fed to a developing roller together with the toner in the toner box, and is next caught between a doctor blade and the developing roller. As a result, the developer deposited on the developing roller is not well fed at the doctor blade where the foreign matter has been caught, causing the occurrence of print missing on the photosensitive drum at its surface portion corresponding to the foreign matter covered surface portion of the developing roller.

In the 1.5-component developing device, the carrier chamber storing the carrier is defined between a developing roller and a partition member. When the developing roller is rotated, the toner is supplied from a toner chamber to the carrier chamber, in which the toner is mixed with the carrier and is thereby charged to a given potential. In a conventional structure of the carrier chamber, however, the distance between the partition member and the developing roller at their transversely opposite end portions is gradually reduced. Accordingly, there is a possibility that the developer may be deviated from the opposite end portions to the central portion, with the result that the amount of the carrier at the opposite end portions is reduced. Since the amount of the toner supplied from the toner chamber to the carrier chamber is constant over the axial length of the developing roller, the toner density at the opposite end portions is increased, causing a variation in the toner density in the axial direction of the developing roller. This toner density variation causes image quality degradation such as print density variation and fog.

SUMMARY OF THE INVENTION

It is therefore an object of the present invention to provide an electrophotographic image forming apparatus which can improve the efficiency of reuse of the toner.

It is another object of the present invention to provide an electrophotographic image forming apparatus which can prevent print missing due to foreign matter mixed in the developer.

It is still another object of the present invention to provide an electrophotographic image forming apparatus which can prevent image quality degradation such as print density variation and fog.

In accordance with an aspect of the present invention, there is provided an electrophotographic image forming apparatus comprising an electrostatic latent image carrying member; a charging means for uniformly charging the carrying member; a means for exposing the carrying member to light according to image information to form an electrostatic latent image on the carrying member; a developing means for developing the electrostatic latent image to form a toner image on the carrying member, the developing means comprising a housing for defining a toner chamber, a developing roller rotatably mounted in the housing, an agitator rotatably mounted in the housing and provided in the toner chamber, and a partition member mounted to the housing to define a carrier chamber between the partition member and the developing roller; a transferring means for transferring the toner image from the carrying member to a sheet of paper; a means for fixing the toner image transferred to the paper; a cleaning means for cleaning a residual toner from the carrying member; and a circulating means for recovering the residual toner cleaned from the carrying member by the cleaning means to the toner chamber in the developing means.

The circulating means comprises a flexible tube having one end connected to the cleaning means and another end connected to the toner chamber, a coil member rotatably inserted in the flexible tube, and driving means for rotating the coil member. Preferably, the other end of the flexible tube opens through a rear plate of the developing device defining the toner chamber at a transversely central portion of the rear plate.

The housing of the developing device has a toner supply opening communicating with the toner chamber, and foreign matter removing means for removing foreign matter such as paper pieces and dust is provided so as to cover the toner supply opening. The foreign matter removing means comprises a net, for example, and it is vibrated by vibrating means as required. Preferably, at least one projection is formed at a substantially transversely central portion of the partition member opposed to the developing roller. This projection functions to prevent deviation of the developer toward the transversely central portion, thereby obtaining a uniform toner density over the axial length of the developing roller.

The residual toner scraped from the electrostatic latent image carrying member is directly returned to the toner chamber by the circulating means, so that the upward inclination of the circulating means can be made gentle. Accordingly, the residual toner can be prevented from staying at the bottom of the housing of the cleaning means, thereby improving the efficiency of reuse of the toner.

Since the foreign matter removing means is provided so as to cover the toner supply opening, it is possible to prevent the occurrence of print missing due to mixing of foreign matter such as paper pieces and dust into the developer. Further, since the shape of the partition member opposed to the developing roller is optimized, a uniform toner density can be obtained over the axial length of the developing roller.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
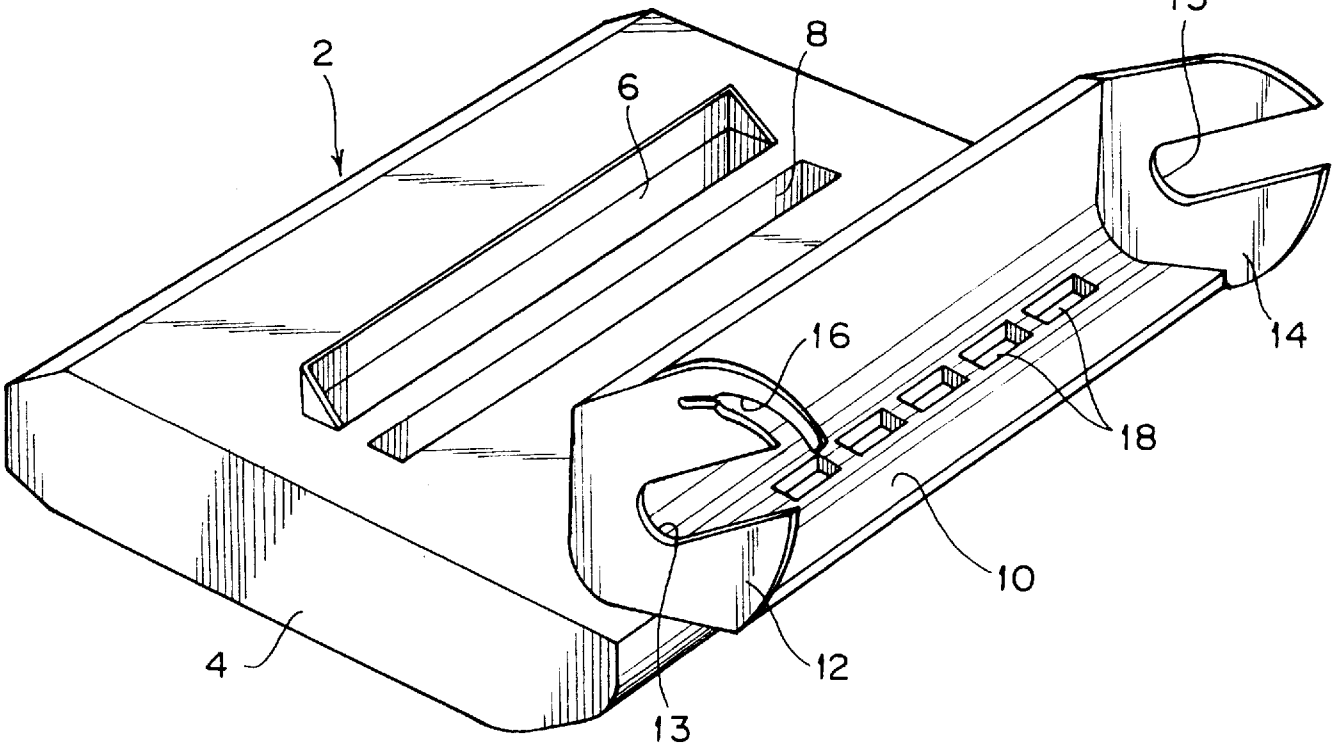
FIG. 1 is an external perspective view of a process unit according to a first preferred embodiment of the present invention.
Figure 2:
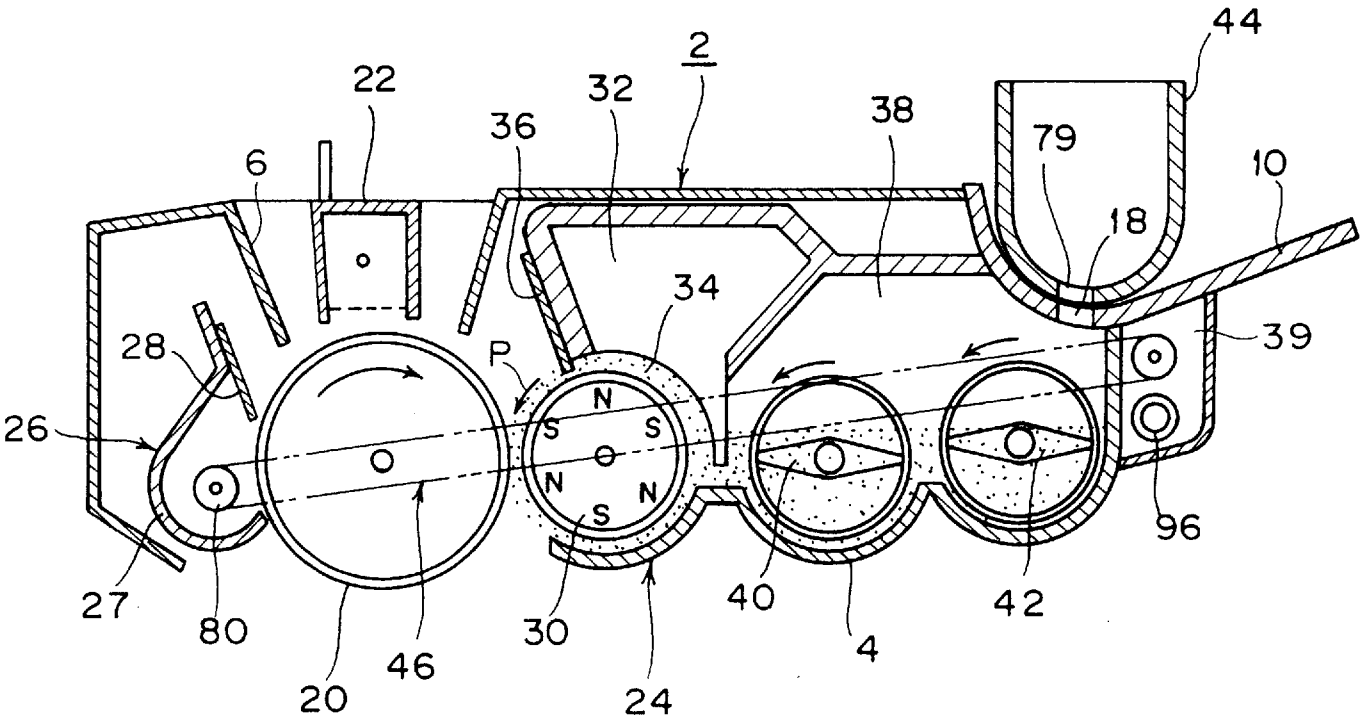
FIG. 2 is a sectional view of the process unit.

Some preferred embodiments of the present invention will now be described in detail with reference to the drawings. Referring to FIGS. 1 and 2, there are respectively shown an external perspective view and a sectional view of a process unit 2 according to a first preferred embodiment of the present invention. As shown in FIG. 2, the process unit 2 is composed of a photosensitive drum 20, a cleaner 26, and a developing device 24. The photosensitive drum 20 and the cleaner 26 are integrated together. The developing device 24 is detachable from the subunit of the photosensitive drum 20 and the cleaner 26. The process unit 2 is detachably mounted in a printer, for example, in the condition that the developing device 24 is mounted to the subunit of the photosensitive drum 20 and the cleaner 26.

As shown in FIG. 1, reference numeral 4 denotes a housing of the process unit 2. The upper surface of the housing 4 is formed with an opening 6 for mounting of a corona charger 22 (see FIG. 2) and an opening 8 for exposure of the photosensitive drum 20 to light from an optical unit (to be hereinafter described). Reference numeral 10 denotes a toner cartridge receiving member, which is integrally formed with a pair of side plates 12 and 14. The side plates 12 and 14 are respectively formed with guide slots 13 and 15 for guiding receipt of a toner cartridge 44 (see FIG. 2) into the receiving member 10. The side plate 12 is further formed with an arcuate slot 16 for allowing rotation of the toner cartridge 44 received in the receiving member 10. The receiving member 10 has a bottom portion formed with a plurality of toner supply openings 18.

As shown in FIG. 2, the corona charger 22 is mounted in the opening 6 of the housing 4 of the process unit 2. The developing device 24 includes a developing roller 30 to be rotated in a direction shown by an arrow P in FIG. 2. A partition member 32 is mounted inside the housing 4, and a carrier chamber or a development chamber 34 is defined between the partition member 32 and the developing roller 30. A developer consisting of a carrier and a toner is stored in the carrier chamber 34. Reference numeral 36 denotes a doctor blade for restricting the thickness of a layer of the developer deposited to the developing roller 30.

Reference numeral 38 denotes a toner chamber for storing the toner. Inside the toner chamber 38, there are rotatably provided first and second agitators 40 and 42 for agitating the toner stored in the toner chamber 38. The toner cartridge 44 is detachably mounted on the cartridge receiving member 10. The cleaner 26 has a blade 28 kept in contact with the photosensitive drum 20 to scrape a residual toner from the photosensitive drum 20. Reference numeral 46 denotes a toner circulating mechanism for recovering the residual toner stored in a housing 27 of the cleaner 26 to the toner chamber 38 of the developing device 24. The details of the toner circulating mechanism 46 will be hereinafter described.

Figure 3:
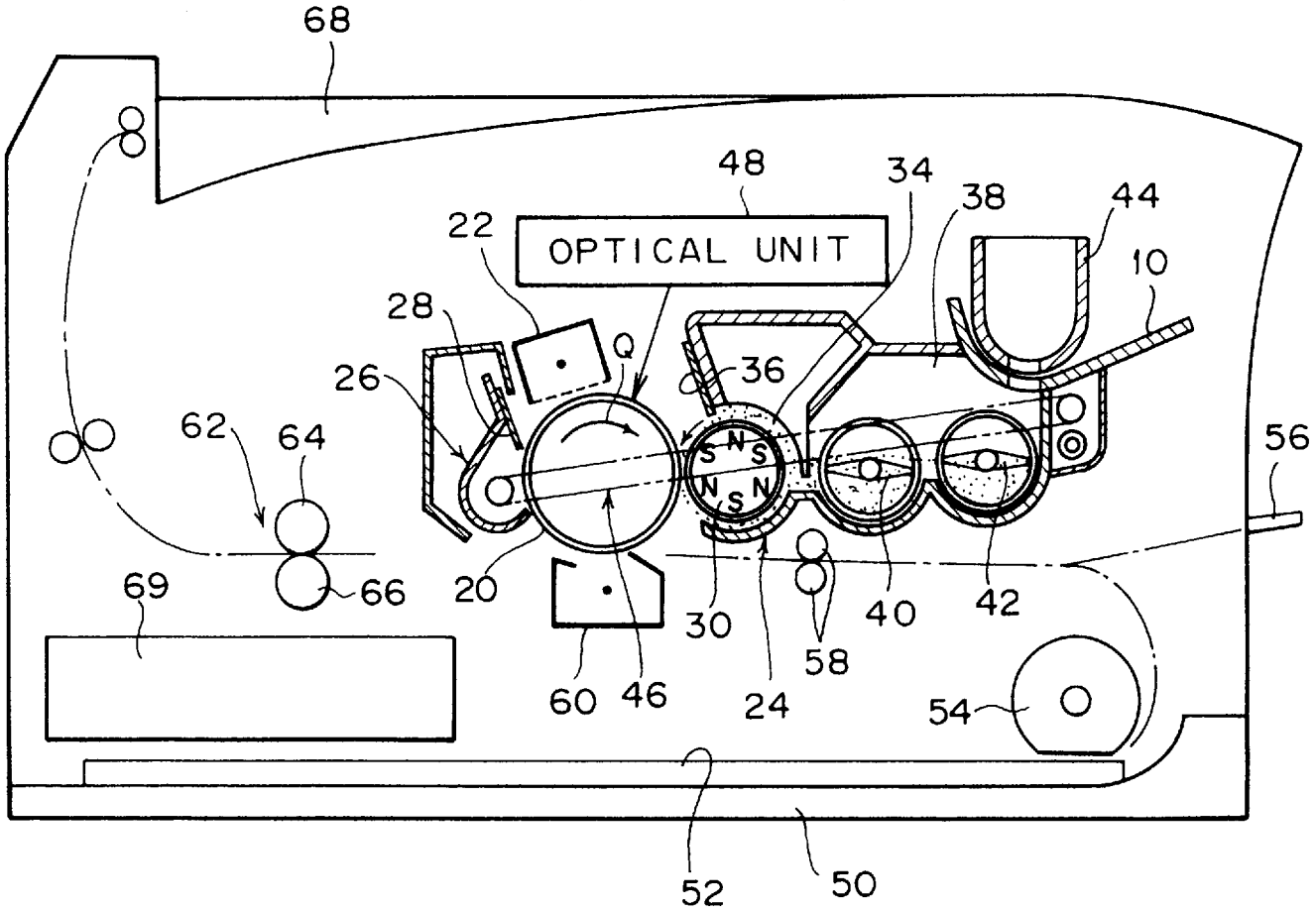
FIG. 3 is a sectional side view of a printer to which the preferred embodiment is applied.

Referring to FIG. 3, there is shown a schematic sectional side view of an LED printer to which the above preferred embodiment of the present invention is applied. The photosensitive drum 20 is configured, for example, by applying a function separation type organic photosensitive material with a thickness of 20 μm to an aluminum drum. The photosensitive drum 20 has an outer diameter of 24 mm, and it is rotated in a direction by an arrow Q at a peripheral speed of 25 mm/s, for example. The corona charger 22 is a scorotron charger, which uniformly charges the cylindrical surface of the photosensitive drum 20 to about −600 V.

Reference numeral 48 denotes an optical unit for exposing the uniformly charged photosensitive drum 20 to light to thereby form an electrostatic latent image on the photosensitive drum 20. In this preferred embodiment, a laser optical unit is adopted as the optical unit 48. The photosensitive drum 20 is exposed to light according to an image pattern by the optical unit 48, thereby forming an electrostatic latent image with a potential of −50 to −100 V. This electrostatic latent image is developed by the developing device 24 having the developing roller 30 to form a toner image on the photosensitive drum 20. The developing roller 30 is composed of a magnet roller having a plurality of magnetic poles, and a sleeve rotating around the magnet roller.

The toner chamber 38 stores the toner supplied from the toner cartridge 44 and the residual toner recovered by the toner circulating mechanism 46. These toners in the toner chamber 38 are agitated to be uniformly mixed together by rotation of the agitators 40 and 42. A given amount of carrier is stored in the carrier chamber 34. The mixed toner in the toner chamber 38 is fed into the carrier chamber 34 by rotation of the agitators 40 and 42, so that the toner density in the carrier chamber 34 is maintained at a substantially constant level. The thickness of the developer layer deposited on the developing roller 30 is restricted by the doctor blade 36 to form a magnetic brush on the developing roller 30. This magnetic brush comes to contact with the electrostatic latent image formed on the photosensitive drum 20 to develop the electrostatic latent image.

Sheets of paper 52 stored in a paper cassette 50 are fed separately by rotation of a pick roller 54. After a feed timing of the paper 52 in relation to the toner image on the photosensitive drum 20 is adjusted by a pair of registration rollers 58, the paper 52 is fed to a transfer unit 60. Reference numeral 56 denotes a manual feed tray. The toner image on the photosensitive drum 20 is electrostatically transferred to the paper 52 by the transfer unit 60. The toner image transferred to the paper 52 is fixed by a fixing unit 62 consisting of a heat roll 64 and a backup roll 66. Then, the paper 52 having the toner image fixed thereon is ejected to a stacker 68. On the other hand, the residual toner left on the photosensitive drum 20 is scraped from the photosensitive drum 20 by the blade 28 of the cleaner 26, and is next returned to the toner chamber 38 by the toner circulating mechanism 46. Reference numeral 69 denotes a printed wiring board on which a control circuit for the printer is mounted.

When the toner in the carrier chamber 34 is consumed by the development operation to decrease in amount, the volume of the developer consisting of the toner and the carrier is reduced. At this time, the toner stored in the toner chamber 38 is supplied in an amount corresponding to the consumption of the toner in the carrier chamber 34, into the carrier chamber 34 by rotation of the agitators 40 and 42, thereby maintaining a constant toner density in the carrier chamber 34. The agitators 40 and 42 function also to correct axial deviation of the toner in the toner chamber 38.

When the toner in the toner chamber 38 is consumed to be absent, this condition is detected by a toner sensor (not shown) and is indicated on a display (not shown) of the printer. In this condition, the empty toner cartridge 44 is removed from the developing device 24 by an operator, and a new toner cartridge 44 filled with toner is remounted to the developing device 24 by the operator to newly supply the toner into the toner chamber 38.

Figure 4A:
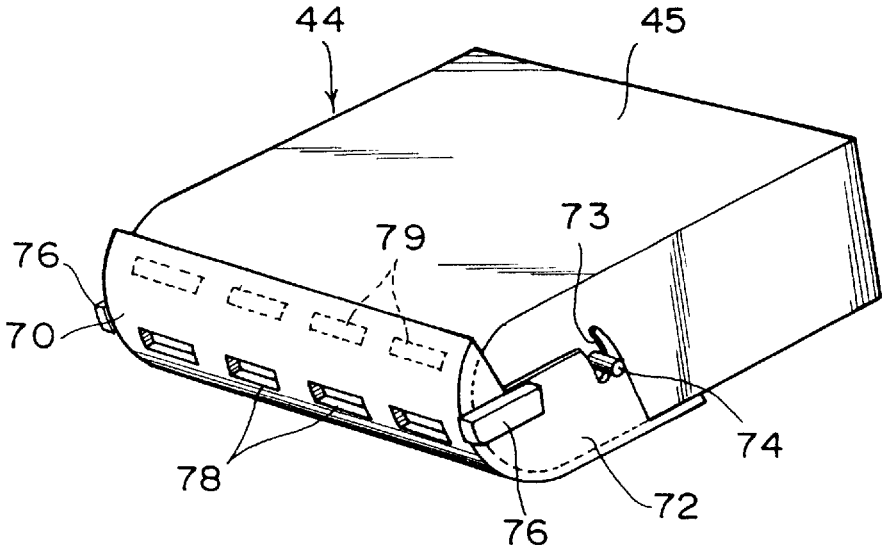
FIGS. 4A and 4B are perspective views of a toner cartridge.

The structure of the toner cartridge 44 and the way of mounting it will now be described with reference to FIGS. 4A, 4B, and 5. As shown in FIG. 4A, the toner cartridge 44 is composed of a cartridge base 70 having a substantially J-shaped cross section, and a cartridge body 45 pivotably mounted on the cartridge base 70. The cartridge base 70 has a pair of side plates 72 (one of which is shown) formed with a pair of projections 76. The projections 76 of the side plates 72 are adapted to be respectively inserted into the guide slots 13 and 15 formed through the side plates 12 and 14 of the cartridge receiving member 10 shown in FIG. 1. The cartridge base 70 has a bottom portion formed with a plurality of openings 78 respectively corresponding to the toner supply openings 18 of the receiving member 10.

One of the two side plates 72 of the cartridge base 70 is further formed with an arcuate slot 73 in which a projection 74 formed on one side surface of the cartridge body 45 is engaged. The cartridge body 45 has a bottom portion formed with a plurality of openings 79 adapted to respectively come into alignment with the openings 78 of the cartridge base 70. As shown in FIG. 4A, the cartridge body 45 and the cartridge base 70 are integrated together by the engagement of the projection 74 of the cartridge body 45 and the arcuate slot 73 of the cartridge base 70. In this engaged condition, the projections 76 of the cartridge base 70 are inserted into the guide slots 13 and 15 of the cartridge receiving member 10, thereby mounting the toner cartridge 44 to the cartridge receiving member 10.

Figure 4B:
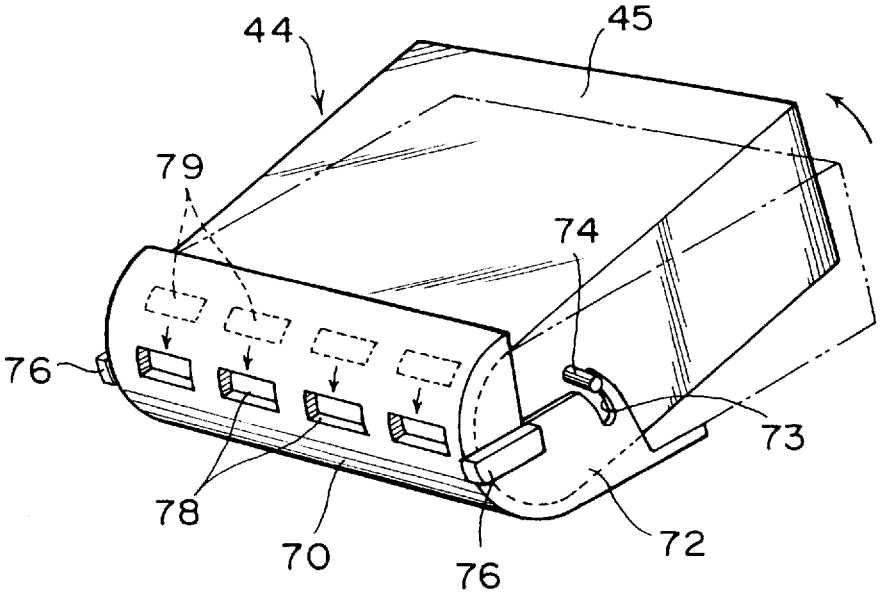
Figure 5:
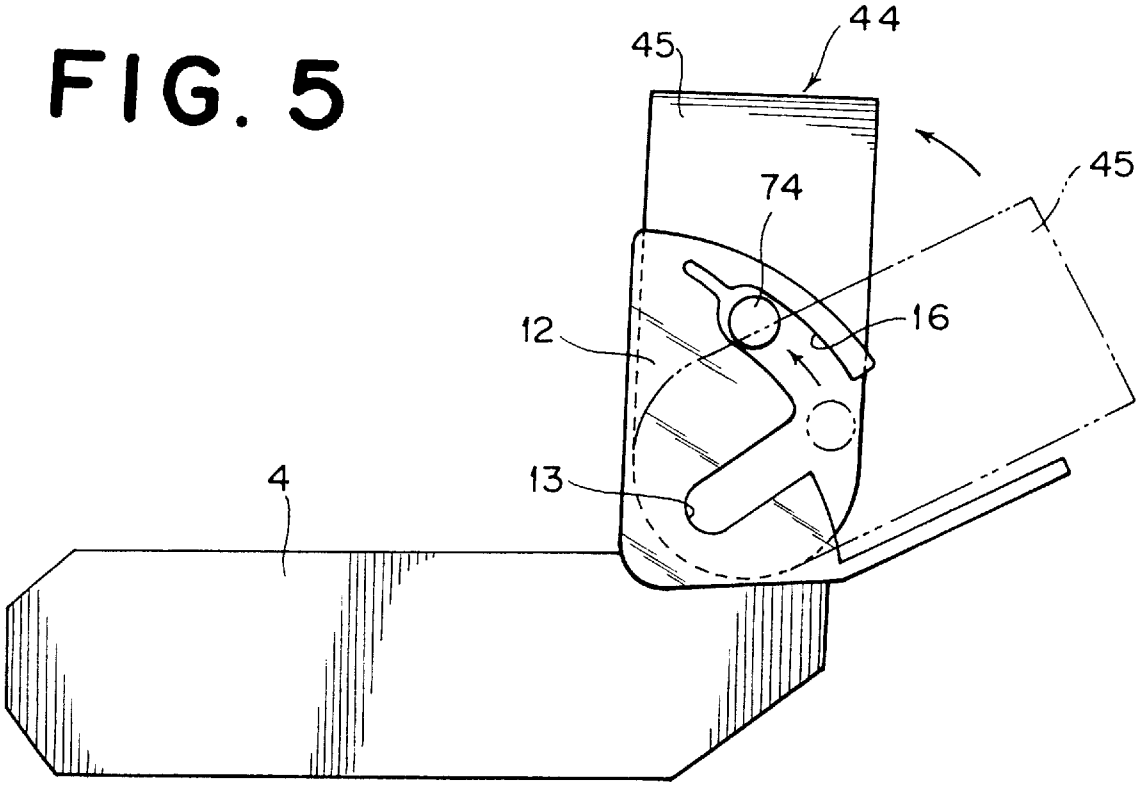
FIG. 5 is a side view illustrating the way of mounting the toner cartridge.

In the condition where the projections 76 are fully inserted into the guide slots 13 and 15 of the cartridge receiving member 10, the cartridge body 45 is rotated relative to the cartridge base 70 as shown in FIG. 4B. Accordingly, the projection 74 of the cartridge body 45 is disengaged from the slot 73 of the cartridge base 70, and then comes into engagement with the slot 16 of the cartridge receiving member 10. In this condition, the projection 74 of the cartridge body 45 is locked in the slot 16 of the cartridge receiving member 10 as shown by a solid line in FIG. 5. In this condition, the openings 79 of the cartridge body 45 are respectively aligned with the openings 78 of the cartridge base 70 and the toner supply openings 18 of the cartridge receiving member 10, thus allowing supply of the toner contained in the toner cartridge 44 into the toner chamber 38.

Figure 6:
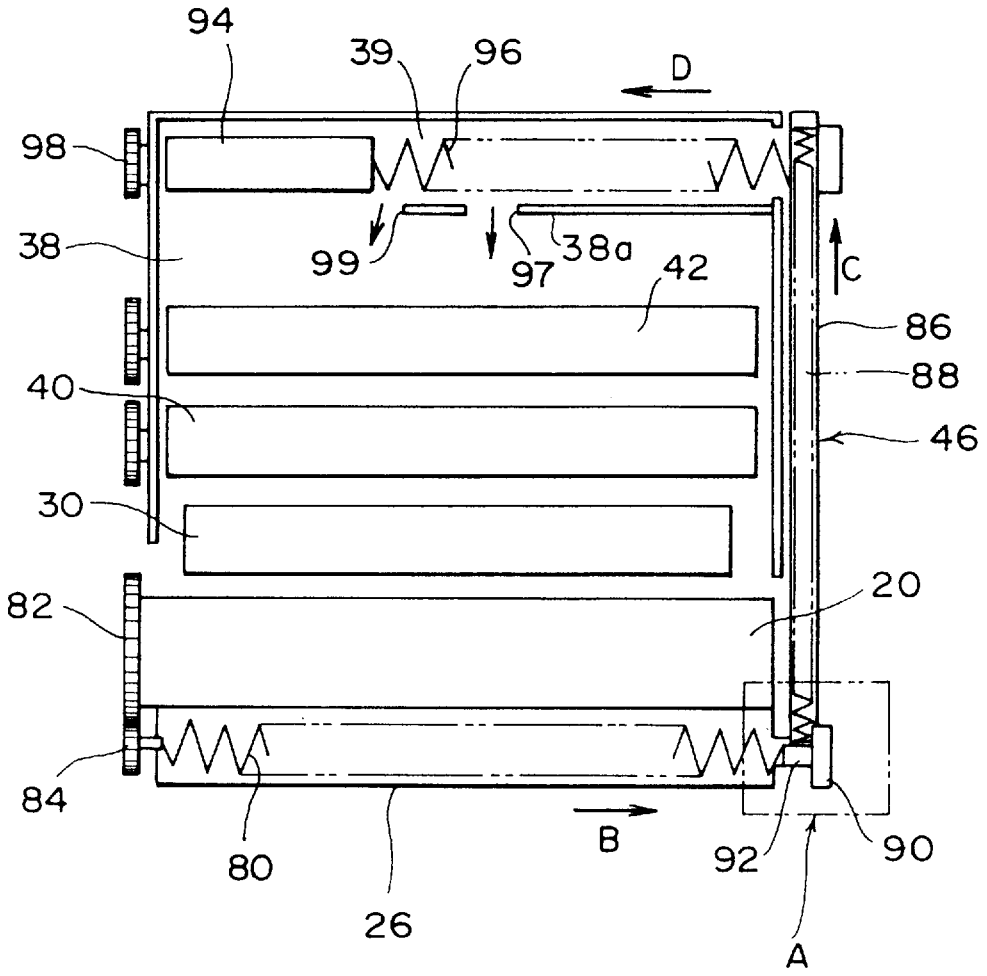
FIG. 6 is a plan view showing a toner circulating mechanism.
Figure 7:
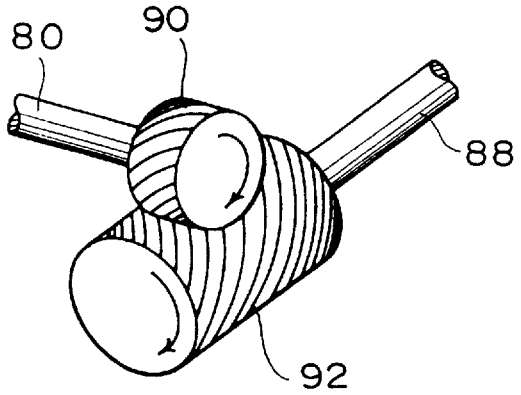
FIG. 7 is an enlarged perspective view of a portion A shown in FIG. 6.

The details of the toner circulating mechanism 46 will now be described with reference to FIG. 6. The cleaner 26 contains a coil member 80 having one end connected to a gear 84 and the other end connected to a helical gear 90. The toner circulating mechanism 46 includes a flexible tube 86 such as a rubber hose, and a coil member 88 contained in the flexible tube 86. As shown in FIG. 7, one end of the coil member 88 is connected to a helical gear 92 meshing with the helical gear 90. A toner recovery chamber 39 adjacent to the toner chamber 38 contains a shaft 94 connected at its one end to a gear 98, and a coil member 96 connected to the other end of the shaft 94.

When the gear 84 meshing with a drive gear 82 for rotating the photosensitive drum 20 is rotated, the coil member 80 is rotated to thereby feed the residual toner in the cleaner 26 in a direction shown by an arrow B. The rotation of the coil member 80 is transmitted through the helical gears 90 and 92 meshing with each other to the coil member 88 contained in the flexible tube 86, so that the coil member 88 is rotated so as to feed the residual toner in a direction shown by an arrow C.

On the other hand, the coil member 96 is rotated by the gear 98 to feed the residual toner returned to the toner recovery chamber 39 in a direction shown by an arrow D, then supplying the residual toner into the toner chamber 38 through openings 97 and 99 formed at a substantially transversely central portion of a rear plate 38*a* defining the toner chamber 38. In this manner, the toner circulating mechanism 46 according to this preferred embodiment allows the residual toner stored in the cleaner 26 to be returned to the substantially transversely central portion of the toner chamber 38, so that the toner supplied from the toner cartridge 44 and the residual toner returned as mentioned above can be uniformly mixed by rotation of the agitator 42.

Figure 8:
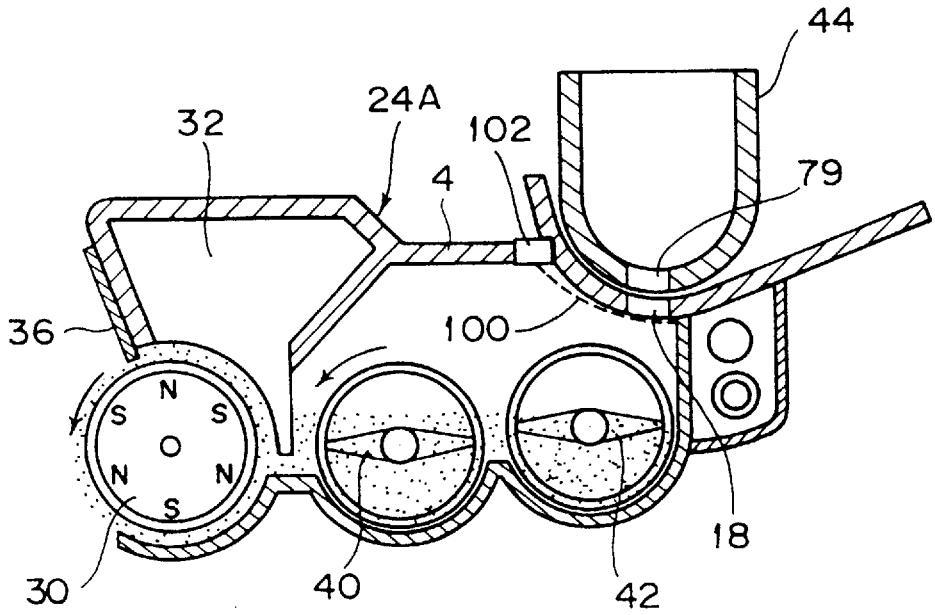
FIG. 8 is a sectional view of a developing device according to a second preferred embodiment of the present invention.

Referring to FIG. 8, there is shown a sectional view of a developing device 24A according to a second preferred embodiment of the present invention. The developing device 24A is characterized in that a foreign matter removing member 100 is provided so as to cover the toner supply openings 18. More specifically, the foreign matter removing member 100 is formed as a net of nylon fibers knitted with a density of 14 fibers/inch. The net 100 is fixed by adhesive to a peripheral portion of the toner supply openings 18.

In replacing the toner cartridge 44 with a new one to supply the toner into the toner chamber 38 in the first preferred embodiment, the toner cartridge 44 is removed from the developing device 24, so that the toner supply openings 18 become exposed. At this time, there is a possibility that foreign matter such as human hair, eraser dust, clothing fiber, and paper pieces may enter the toner chamber 38 from the toner supply openings 18. To cope with this, the net 100 is mounted so as to cover the toner supply openings 18 in the second preferred embodiment. Reference numeral 102 denotes a vibrating mechanism for vibrating the net 100. Unless the vibrating mechanism 102 is provided, there is a possibility that the toner in the cartridge 44 may not be supplied through the net 100 into the toner chamber 38 because of low fluidity of the toner, high-temperature and high-humidity use environment of the printer, fine mesh of the net 100, etc.

Figure 9:
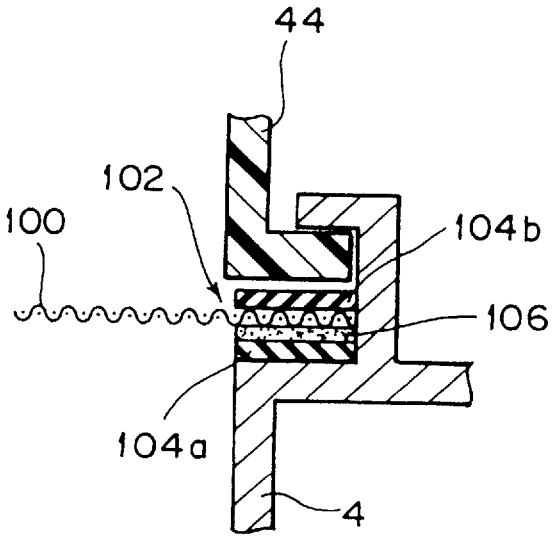
FIG. 9 is a sectional view showing a vibrating mechanism for a foreign matter removing net.

To solve this problem, the net 100 is vibrated by the vibrating mechanism 102 as required. The structure of the vibrating mechanism 102 for the foreign matter removing net 100 will now be described with reference to FIG. 9. As shown in FIG. 9, a sponge cushion 104*a*, a plurality of piezoelectric vibrators 106, the foreign matter removing net 100, and a sponge cushion 104*b* are stacked in this order and bonded together at a peripheral portion of the toner supply openings 18. The plural piezoelectric vibrators 106 are provided so as to correspond to the plural toner supply openings 18, so as to vibrate the net 100 covering the toner supply openings 18. Accordingly, by operating the piezoelectric vibrators 106 as required, the net 100 is vibrated to thereby allow smooth supply of the toner through the net 100 into the toner chamber 38.

Figure 10:
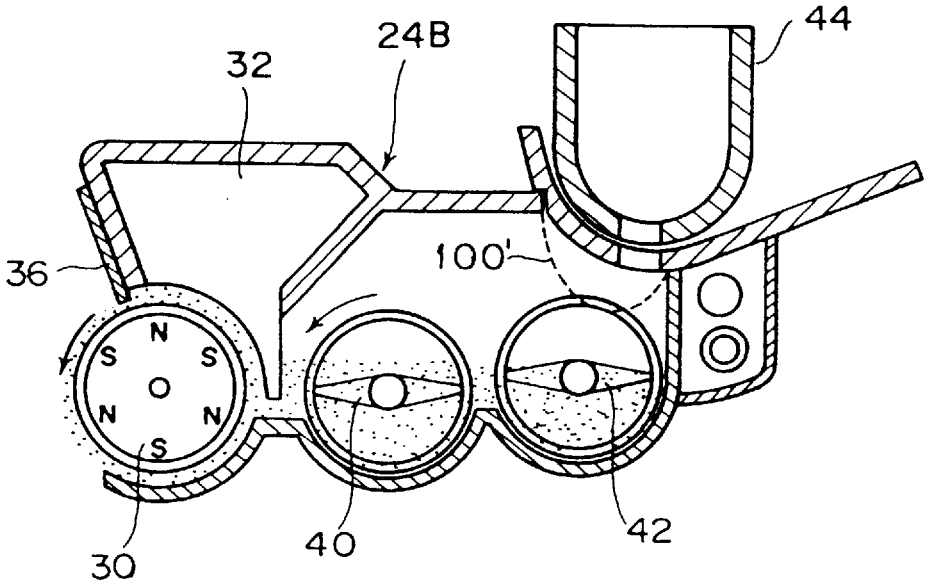
FIG. 10 is a sectional view of a developing device according to a third preferred embodiment of the present invention.

FIG. 10 is a sectional view of a developing device 24B according to a third preferred embodiment of the present invention. In this preferred embodiment, a foreign matter removing net 100' is provided so as to interfere with a locus of rotation of the agitator 42. Accordingly, the net 100' can be vibrated by the rotational operation of the agitator 42.

Figure 11:
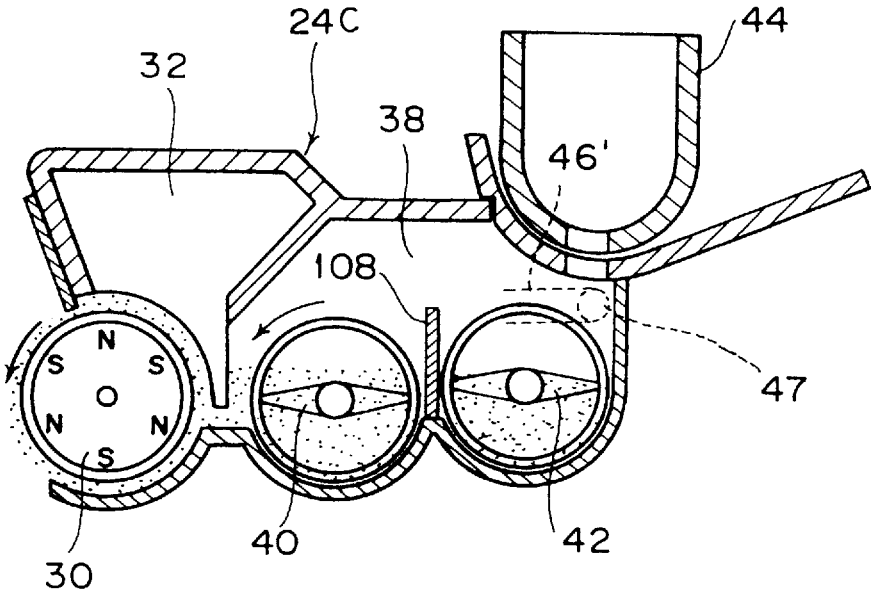
FIG. 11 is a sectional view of a developing device according to a fourth preferred embodiment of the present invention.

Referring to FIG. 11, there is shown a sectional view of a developing device 24C according to a fourth preferred embodiment of the present invention. In this preferred embodiment, a return end 47 of a toner circulating mechanism 46' opens through a side plate defining the toner chamber 38. Furthermore, a foreign matter removing net 108 is provided between the first agitator 40 and the second agitator 42. Unless the foreign matter removing net 108 is provided, there is a possibility that foreign matter such as paper pieces, dust, and large-sized toner particles possibly contained in the residual toner returned by the toner circulating mechanism 46' may be fed to the developing roller 30, causing the occurrence of print missing. According to this preferred embodiment, the foreign matter removing net 108 can prevent the foreign matter mixed in the residual toner from being fed to the developing roller 30, thereby achieving good development with no print missing.

Figure 12A:
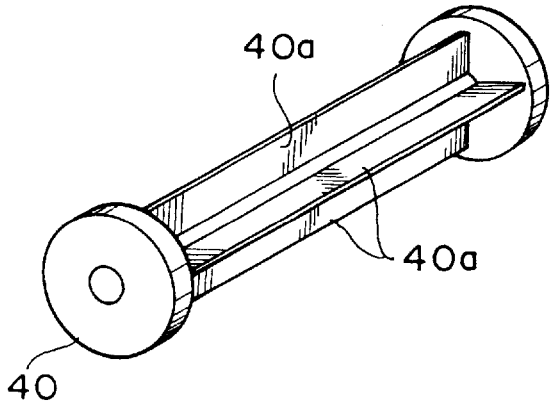
FIG. 12A is a perspective view of an agitator.
Figure 12B:
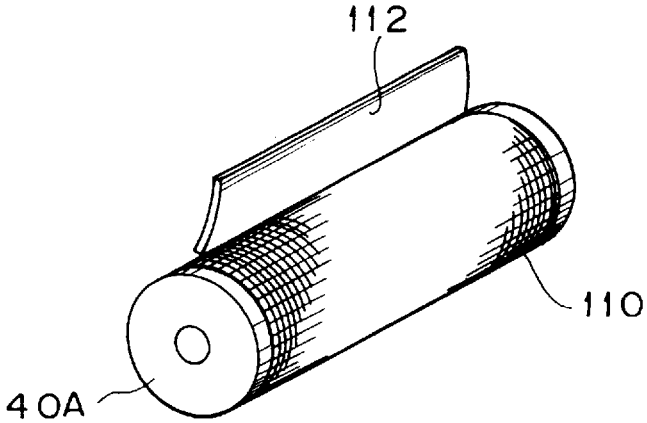
FIG. 12B is a perspective view of a modification of the agitator, in which the outer circumference of the agitator is surrounded by a net.

FIG. 12A shows the agitator 40 having a plurality of vanes 40*a* as employed in the first to fourth preferred embodiments. FIG. 12B shows an improved agitator 40A provided with a foreign matter removing net 110 surrounding the outer circumference of the agitator 40 and with a blade 112 pressed on the net 110. With this arrangement, movement of foreign matter such as large-sized toner particles and dust remaining on the net 110 can be prevented by the blade 112, thus preventing the foreign matter from being fed to the developing roller 30.

Figure 13A:
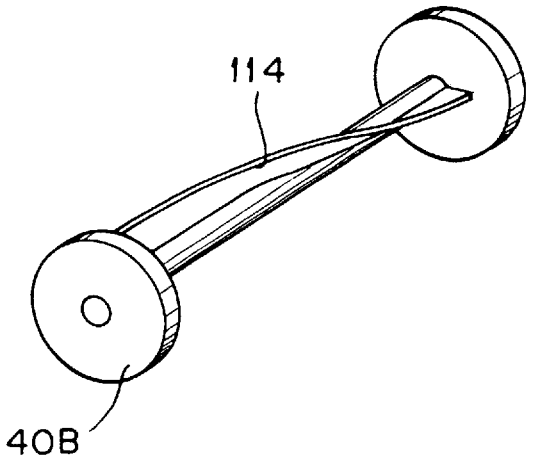
FIGS. 13A and 13B are perspective views of further modifications of the agitator.
Figure 13B:
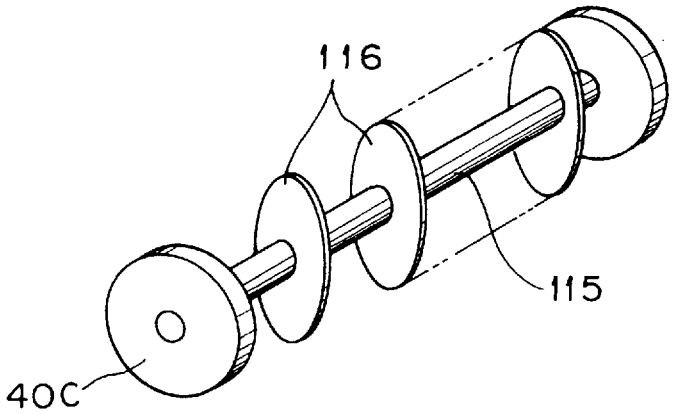

FIGS. 13A and 13B shows other modifications of the agitator 40. FIG. 13A shows an agitator 40B having a twisted vane 114. By rotation of the agitator 40B, the twisted vane 114 provides a force for axially moving the toner in the toner chamber, so that the residual toner returned by the toner circulating mechanism can be quickly axially moved to be uniformed. FIG. 13B shows an agitator 40C having a plurality of vanes 116 inclined to a shaft 115. Like the agitator 40B shown in FIG. 13A, the agitator 40C can provide an axial force to the toner.

In the case of using the agitator 40B shown in FIG. 13A as the first agitator 40, the second agitator 42 must be an agitator having a twisted vane whose direction of twist is opposite to that of the twisted vane 114 of the agitator 40B. Further, in the case of using the agitator 40C shown in FIG. 13B as the first agitator 40, the second agitator 42 must be an agitator having a plurality of inclined vanes whose direction of inclination is opposite to that of the vanes 116 of the agitator 40C.

Figure 14:
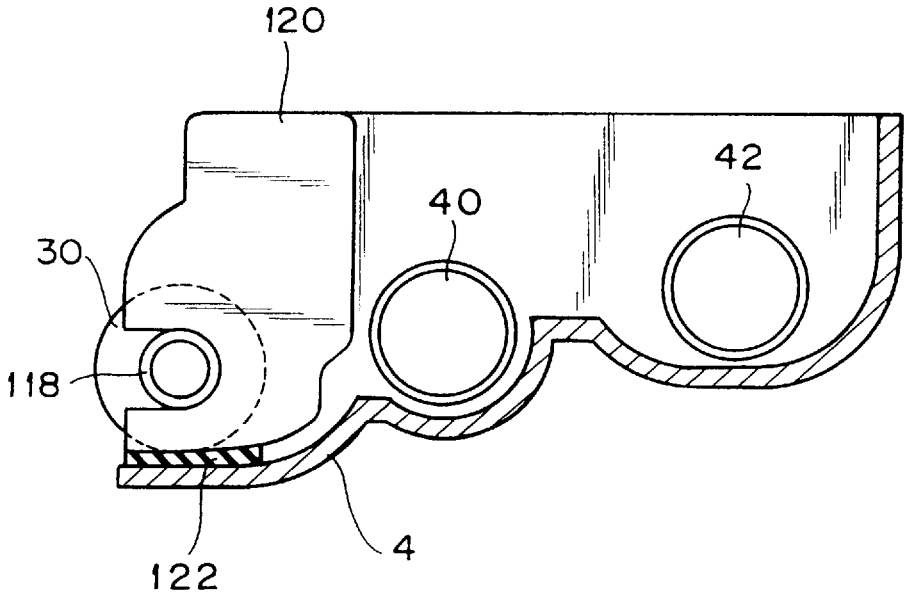
FIG. 14 is a sectional view showing a supporting mechanism for a developing roller.

A supporting mechanism for the developing roller 30 will now be described with reference to FIG. 14. The developing roller 30 is rotatably supported through a pair of bearings 118 to a bracket 120. The bracket 120 serves also as a reinforcing member for ensuring the strength of the developing device as a whole. Further, other members requiring a mount accuracy, including the doctor blade 36, are also mounted on the bracket 120. The bracket 120 is mounted on the housing 4 with a vibration isolating member 122 such as elastic rubber being interposed therebetween.

Since the vibration isolating member 122 is interposed between the housing 4 and the bracket 120, transmission of vibration of the housing 4 to the bracket 120 can be prevented, thereby preventing vibration of the developing roller 30. Accordingly, a gap between the developing roller 30 and the photosensitive drum 20 can be always maintained at a constant value. In the case where the bracket 120 is not used for mounting of the developing roller 30, the vibration isolating member 122 may be interposed between the housing 4 and a rotating shaft of the developing roller 30, or may be interposed between the housing 4 and the bearings 118 supporting the rotating shaft of the developing roller 30. Also in this case, transmission of vibration of the housing 4 to the developing roller 30 can be effectively prevented.

Figure 15:
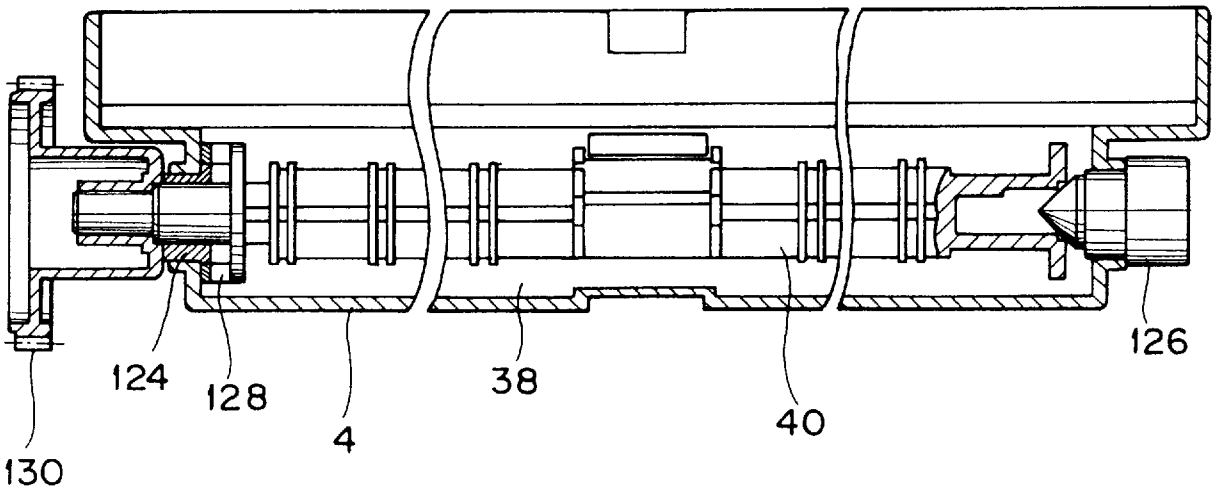
FIG. 15 is a sectional view showing a supporting mechanism for the agitator.

A supporting mechanism for the agitator 40 will now be described with reference to FIG. 15. Although not shown, a supporting mechanism for the other agitator 42 is similar to that for the agitator 40. One end of the agitator 40 is supported by a sleeve bearing 124, and the other end is supported by a pivot bearing 126. Reference numeral 128 denotes a sponge seal for preventing leakage of the toner in the toner chamber 38 from the sleeve bearing 124. The pivot bearing 126 is formed of resin, and it is fixed to the housing 4. Accordingly, there is no possibility of leakage of the toner in the toner chamber 38 from the pivot bearing 126.

The use of the pivot bearing 126 for supporting the end of the agitator 40 can prevent an increase in rotational torque of the agitator 40 due to entry of the toner into a sleeve bearing as used in the prior art. Accordingly, torsion of the toner chamber 38 can be prevented to thereby suppress print density variation and fog due to deformation of the toner chamber 38.

Figure 16A:
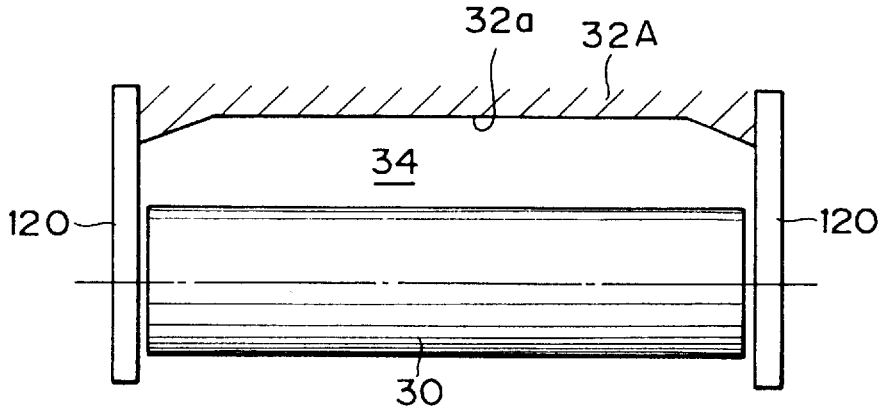
FIGS. 16A and 16B are sectional plan views showing partition members having specific shapes.
Figure 16B:
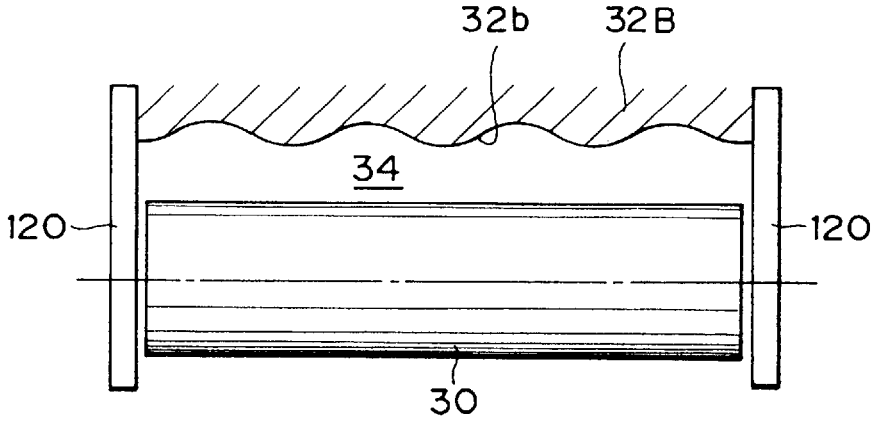

Various shapes of the partition member 32 contributing to uniform mixing of carrier and toner in the carrier chamber 34 and prevention of toner density variation will now be described with reference to FIGS. 16A to 21B. Throughout FIGS. 16A to 21B, the carrier chamber (development chamber) 34 is defined between the developing roller 30 and the partition member 32. More specifically, FIG. 16A shows a partition member 32A having a wall surface 32*a* roughened by surface treatment. For example, the wall surface 32*a* is roughened by grinding or polishing, or by sand blast. Owing to the rough wall surface 32*a*, the toner and the carrier in the carrier chamber 34 can be easily uniformly mixed. FIG. 16B shows a partition member 32B having an uneven wall surface 32*b* so as to improve the mixing of the toner and the carrier. Most preferably, the wall surface 32*b* of the partition member 32B has a wavy shape, thereby facilitating movement of the developer in the axial direction of the developing roller 30.

Figure 17A:
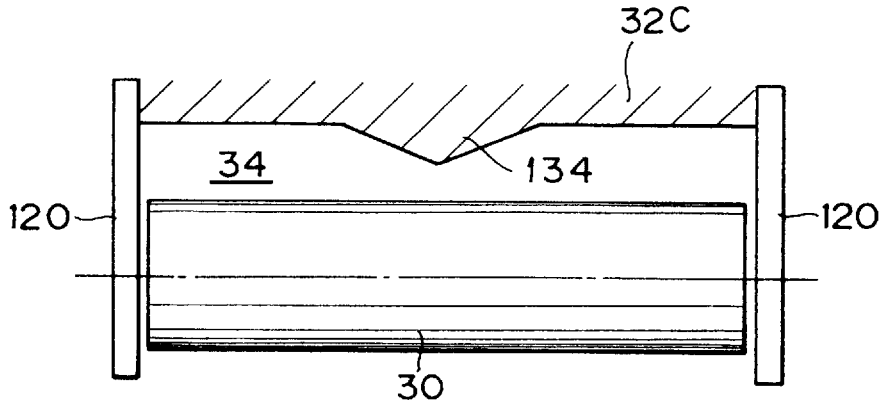
FIGS. 17A, 17B, 18A, 18B, 19, 20A, 20B, 21A and 21B, respectively, are sectional plan views showing partition members having other specific shapes.
Figure 17B:
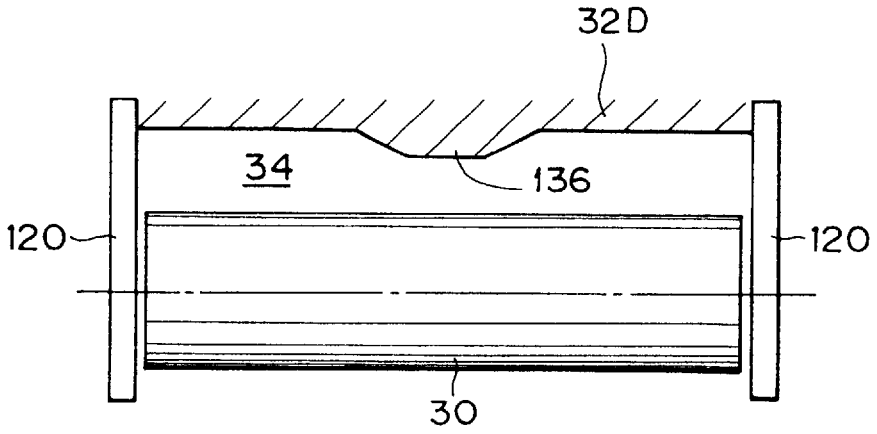
Figure 18A:
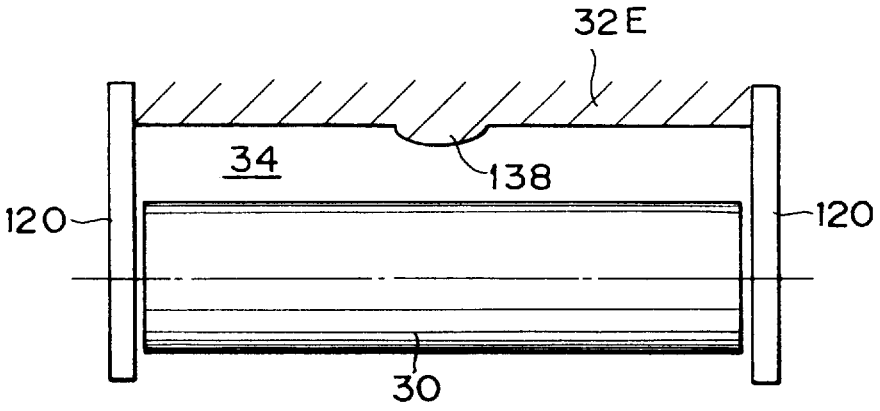
Figure 18B:
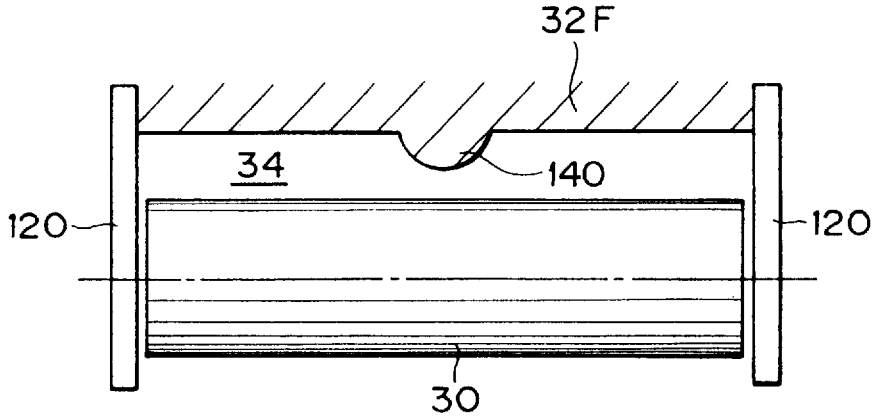

FIGS. 17A to 18B show other preferable shapes of the partition members 32C to 32F. Throughout FIGS. 17A to 18B, a projection is formed on the wall surface of the partition member 32 at a substantially transversely central portion thereof opposed to the developing roller 30. More specifically, FIG. 17A shows a partition member 32C having a sectionally triangular projection 134; FIG. 17B shows a partition member 32D having a sectionally trapezoidal projection 136; FIG. 18A shows a partition member 32E having a sectionally elliptic projection 138; and FIG. 18B shows a partition member 32F having a sectionally circular projection 140. Owing to such a projection formed at the substantially transversely central portion of the partition member 32, axial flow of the developer can be suppressed to prevent axial deviation of the developer in the carrier chamber 34, thereby preventing toner density variation and obtaining a good image quality.

Figure 19:
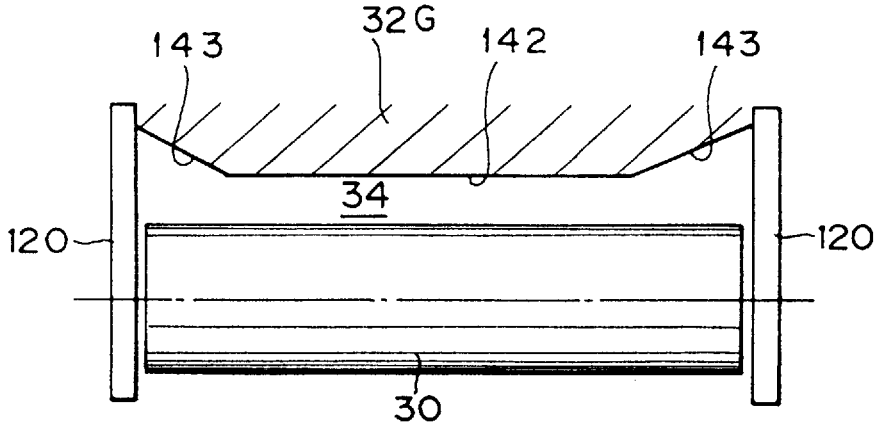

FIG. 19 shows a partition member 32G having another preferable shape. That is, the partition member 32G has a transversely central wall surface 142 substantially parallel to the developing roller 30 and a pair of transversely end wall surfaces 143 extending from the wall surface 142 so as to gradually come away from the developing roller 30 toward the bracket 120. With this specific shape, it is possible to increase the volume of the carrier chamber 34 at its opposite end portions where toner density is increased by axial movement of the developer. Accordingly, the whole toner density in the carrier chamber 34 can be uniformed to thereby prevent fog and toner density variation on the photosensitive drum 20, thus obtaining a good image quality.

Figure 20A:
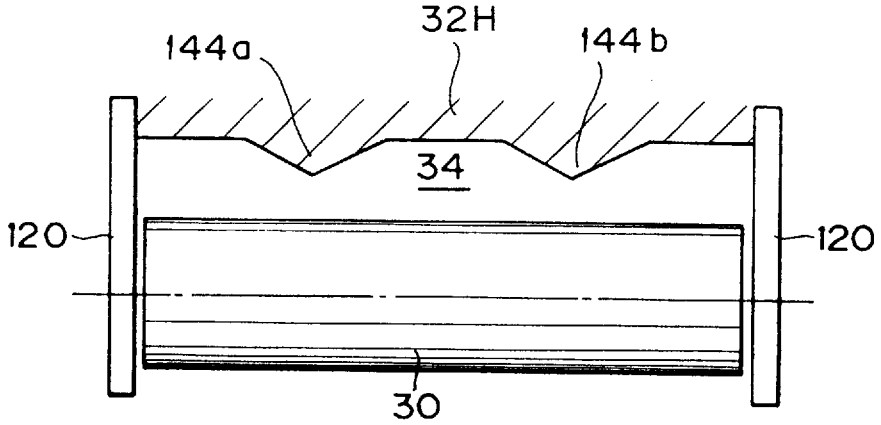
Figure 20B:
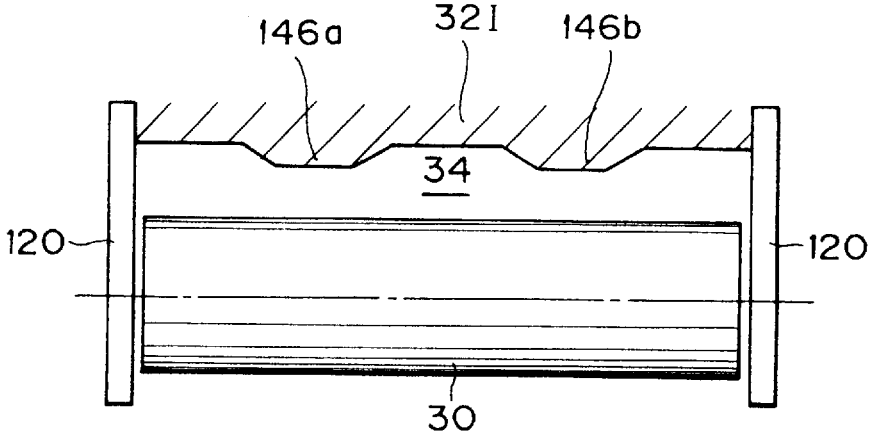
Figure 21A:
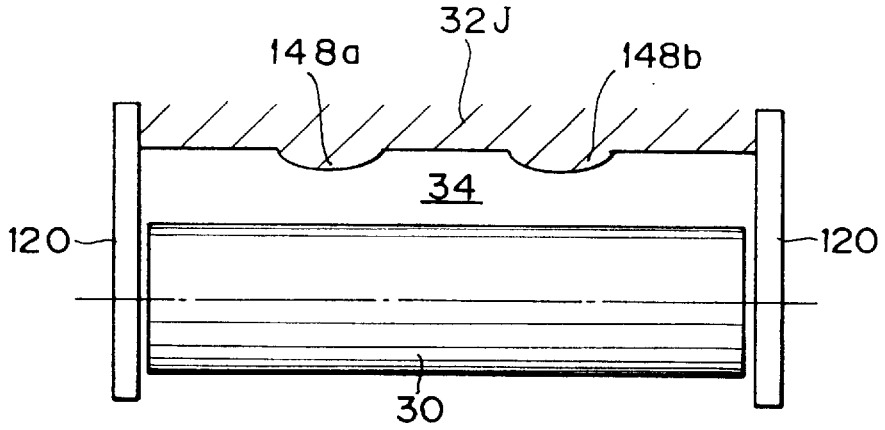
Figure 21B:
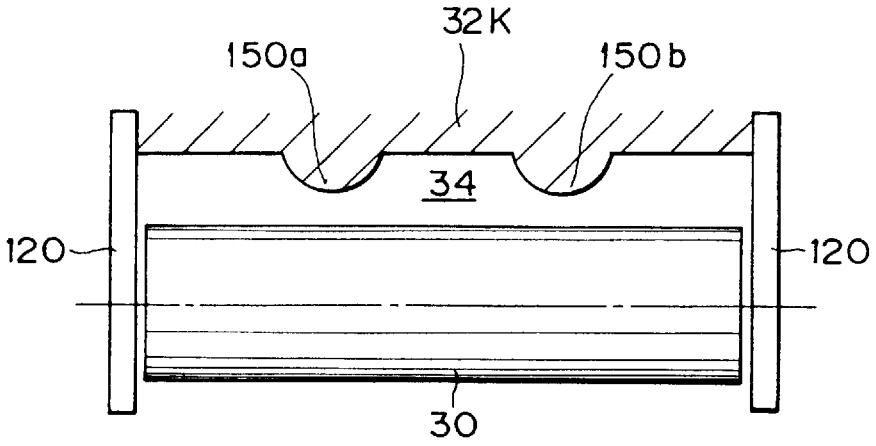

FIGS. 20A to 21B show partition members 32H to 32K having other preferable shapes. Throughout FIGS. 20A to 21B, a plurality of (two in each figure) projections are formed on the wall surface of the partition member 32 opposed to the developing roller 30. More specifically, FIG. 20A shows a partition member 32H having two sectionally triangular projections 144*a* and 144*b*; FIG. 20B shows a partition member 32I having two sectionally trapezoidal projections 146*a* and 146*b*; FIG. 21A shows a partition member 32J having two sectionally elliptic projections 148*a* and 148*b*; and FIG. 21B shows a partition member 32K having two sectionally circular projections 150*a* and 150*b*. With these specific shapes, axial flow of the developer from the opposite end portions toward the central portion of the carrier chamber 34 can be suppressed to thereby uniform the toner density over the axial length of the developing roller 30.

Figure 22A:
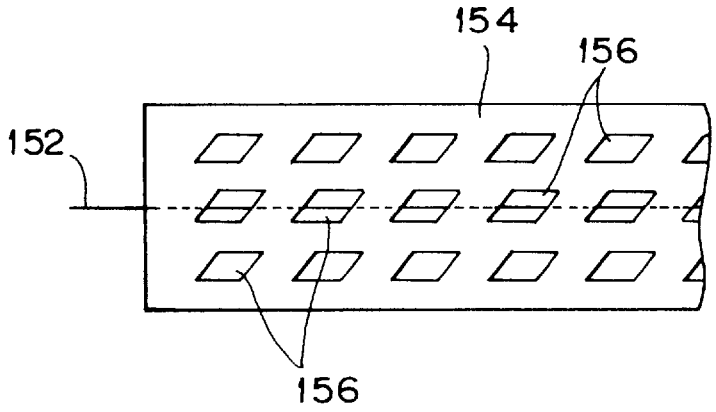
FIGS. 22A and 22B are plan views showing grid electrodes having specific shapes in a scorotron charger.
Figure 22B:
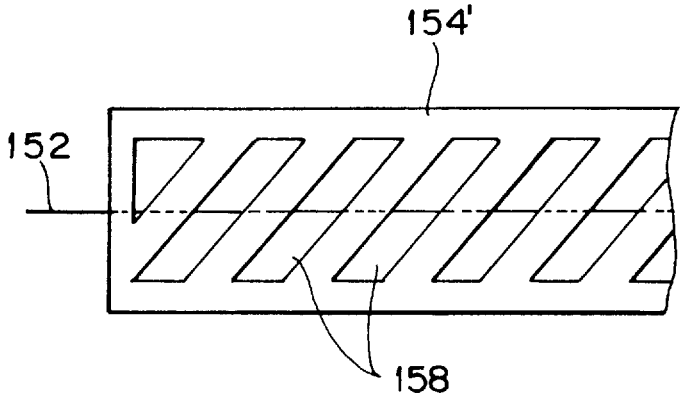

Referring to FIGS. 22A and 22B, there are shown different preferable shapes of a grid electrode of the scorotron charger 22 according to the above preferred embodiment. In a conventional scorotron charger, a grid electrode opposed to a corona wire has no openings, so that the corona wire and a photosensitive drum are shielded from each other by the grid electrode. Accordingly, there is a possibility of nonuniformity of charging of the photosensitive drum, causing a problem that halftone reproducibility becomes low in particular.

To cope with this, the scorotron charger 22 according to the present invention is improved so that a grid electrode 154 opposed to a corona wire 152 has a plurality of parallelogrammatic openings 156 as shown in FIG. 22A. Alternatively, as shown in FIG. 22B, a grid electrode 154' may have a plurality of large parallelogrammatic openings 158. Owing to the formation of the openings 156 or 158 through the grid electrode 154 or 154' opposed to the corona wire 152, the surface of the photosensitive drum 20 can be uniformly charged to thereby improve halftone reproducibility.

The present invention has the following effects.

(1) Since the residual toner is directly returned from the cleaner to the toner chamber of the developing device, the inclination of the toner circulating mechanism can be made gentle. Accordingly, the residual toner is prevented from staying at the bottom of the cleaner, thereby improving the efficiency of reuse of the toner.

(2) Since the foreign matter removing member is provided to prevent foreign matter such as paper pieces, dust, and large-sized toner particles from being fed to the developing roller, a good image with no print missing can be obtained.

(3) Since the shape of the partition member defining the carrier chamber is optimized, the toner density in the carrier chamber can be uniformed over the axial length of the developing roller, thereby obtaining a good image with no fog and no print density variation.

What is claimed is:

1. An electrophotographic image forming apparatus comprising:

an electrostatic latent image carrying member;

charging means for uniformly charging said carrying member;

means for exposing said carrying member to light according to image information to form an electrostatic latent image on said carrying member;

developing means for developing said electrostatic latent image to form a toner image on said carrying member, said developing means including a housing for defining a toner chamber, a developing roller rotatably mounted to said housing, an agitator rotatably mounted to said housing and provided in said toner chamber, and a partition member mounted to said housing to define a carrier chamber between said partition member and said developing roller, wherein said housing has a toner supply opening adapted to supply toner from outside said housing and communicating with said toner chamber, and said developing means further comprises a foreign matter removing means provided so as to cover said toner supply opening, wherein said developing means further comprises a vibrating means for vibrating said foreign matter removing means;

transferring means for transferring said toner image from said carrying member to a sheet of paper;

means for fixing said toner image transferred to said paper;

cleaning means for cleaning a residual toner from said carrying member; and circulating means for recovering said residual toner cleaned from said carrying member by said cleaning means to said toner chamber in said developing means.

2. An electrophotographic image forming apparatus according to claim 1, wherein said vibrating means comprises a piezoelectric vibrator.

3. An electrophotographic image forming apparatus comprising:

an electrostatic latent image carrying member;

charging means for uniformly charging said carrying member;

means for exposing said carrying member to light according to image information to form an electrostatic latent image on said carrying member;

developing means for developing said electrostatic latent image to form a toner image on said carrying member, said developing means including a housing for defining a toner chamber, a developing roller rotatably mounted to said housing, an agitator rotatably mounted to said housing and provided in said toner chamber, and a partition member mounted to said housing to define a carrier chamber between said partition member and said developing roller, wherein said housing has a toner supply opening adapted to supply toner from outside said housing and communicating with said toner chamber, and said developing means further comprises a foreign matter removing means provided so as to cover said toner supply opening, wherein said foreign matter removing means comprises a net located so as to come into contact with an outer circumference of said agitator;

transferring means for transferring said toner image from said carrying member to a sheet of paper;

means for fixing said toner image transferred to said paper;

cleaning means for cleaning a residual toner from said carrying member; and circulating means for recovering said residual toner cleaned from said carrying member by said cleaning means to said toner chamber in said developing means.

4. An electrophotographic image forming apparatus comprising:

an electrostatic latent image carrying member;

charging means for uniformly charging said carrying member;

means for exposing said carrying member to light according to image information to form an electrostatic latent image on said carrying member;

developing means for developing said electrostatic latent image to form a toner image on said carrying member, said developing means including a housing for defining a toner chamber, a developing roller rotatably mounted to said housing, an agitator rotatably mounted to said housing and provided in said toner chamber, and a partition member mounted to said housing to define a carrier chamber between said partition member and said developing roller, wherein said agitator comprises a first agitator and a second agitator spaced from said first agitator, and a mesh-like foreign matter removing means is located between said first agitator and said second agitator;

transferring means for transferring said toner image from said carrying member to a sheet of paper;

means for fixing said toner image transferred to said paper;

cleaning means for cleaning a residual toner from said carrying member; and circulating means for recovering said residual toner cleaned from said carrying member by said cleaning means to said toner chamber in said developing means.

5. An electrophotographic image forming apparatus comprising:

an electrostatic latent image carrying member;

charging means for uniformly charging said carrying member;

means for exposing said carrying member to light according to image information to form an electrostatic latent image on said carrying member;

developing means for developing said electrostatic latent image to form a toner image on said carrying member, said developing means including a housing for defining a toner chamber, a developing roller rotatably mounted to said housing, an agitator rotatably mounted to said housing and provided in said toner chamber, and a partition member mounted to said housing to define a carrier chamber between said partition member and said developing roller, wherein said partition member has a wall surface comprising a transversely central portion parallel to said developing roller and a pair of transversely opposite end portions extending from said transversely central portion so as to gradually come away from said developing roller;

transferring means for transferring said toner image from said carrying member to a sheet of paper;

means for fixing said toner image transferred to said paper;

cleaning means for cleaning a residual toner from said carrying member; and circulating means for recovering said residual toner cleaned from said carrying member by said cleaning means to said toner chamber in said developing means.

6. An electrophotographic image forming apparatus comprising:

an electrostatic latent image carrying member;

charging means for uniformly charging said carrying member;

means for exposing said carrying member to light according to image information to form an electrostatic latent image on said carrying member;

developing means for developing said electrostatic latent image to form a toner image on said carrying member, said developing means including a housing for defining a toner chamber, a developing roller rotatably mounted to said housing, an agitator rotatably mounted to said housing and provided in said toner chamber, and a partition member mounted to said housing to define a carrier chamber between said partition member and said developing roller;

transferring means for transferring said toner image from said carrying member to a sheet of paper;

means for fixing said toner image transferred to said paper;

cleaning means for cleaning a residual toner from said carrying member; and circulating means for recovering said residual toner cleaned from said carrying member by said cleaning means to said toner chamber in said developing means, said circulating means including a rear plate disposed in said housing for defining a toner recovery chamber, said rear plate having an opening formed at a substantially transversely central portion thereof allowing communication between said toner recovery chamber and said toner chamber therethrough, and a tube having one end connected to said cleaning means and another end connected to said toner recovery chamber.

7. An electrophotographic image forming apparatus according to claim 6, wherein said housing has a toner supply opening adapted to supply toner from outside said housing and communicating with said toner chamber, and said developing means further comprises a foreign matter removing means provided so as to cover said toner supply opening.

8. An electrophotographic image forming apparatus according to claim 6, wherein said partition member has a roughened wall surface opposed to said developing roller.

9. An electrophotographic image forming apparatus according to claim 6, wherein said partition member has an uneven wall surface opposed to said developing roller.

10. An electrophotographic image forming apparatus according to claim 6, wherein said partition member has a wall surface formed with at least one projection opposed to said developing roller.

11. An electrophotographic image forming apparatus according to claim 10, wherein said projection has a triangular cross section.

12. An electrophotographic image forming apparatus according to claim 10, wherein said projection has a trapezoidal cross section.

13. An electrophotographic image forming apparatus according to claim 10, wherein said projection has an elliptic cross section.

14. An electrophotographic image forming apparatus according to claim 10, wherein said projection has a circular cross section.

15. An electrophotographic image forming apparatus according to claim 6, wherein said developing means further comprises a mounting member for rotatably mounting said developing roller and a vibration isolating member interposed between said mounting member and said housing, said vibration isolating member being a sponge cushion.

16. An electrophotographic image forming apparatus according to claim 6, wherein said agitator has a shaft, at least one end of said shaft being supported by a pivot bearing.

17. An electrophotographic image forming apparatus according to claim 6, wherein said charging means comprises a corona charger having a corona wire and a grid electrode, said grid electrode having a plurality of openings opposed to said corona wire.

18. An electrophotographic image forming apparatus according to claim 17, wherein each of said openings is parallelogrammatic.

* * * * *